US007763785B2

(12) United States Patent
Gaudet et al.

(10) Patent No.: US 7,763,785 B2
(45) Date of Patent: Jul. 27, 2010

(54) MUSICAL STRING NETWORKS

(76) Inventors: Samuel Gaudet, 87 Rennick road, Moncton, New Brunswick (CA) E1G 4T9; Claude Gauthier, 595 Dover road, Dieppe, New Brunswick (CA) E1A 7L8

( * ) Notice: Subject to any disclaimer, the term of this patent is extended or adjusted under 35 U.S.C. 154(b) by 1216 days.

(21) Appl. No.: 10/844,916

(22) Filed: May 12, 2004

(65) Prior Publication Data

US 2004/0226430 A1 Nov. 18, 2004

Related U.S. Application Data

(60) Provisional application No. 60/469,590, filed on May 12, 2003.

(51) Int. Cl.
*G10D 13/02* (2006.01)

(52) U.S. Cl. ..... 84/297 S

(58) Field of Classification Search ..... 84/297 R, 84/307, 290, 297 S

See application file for complete search history.

(56) References Cited

U.S. PATENT DOCUMENTS 1,716,570 A * 6/1929 Winslow ..... 84/297 R
6,124,536 A * 9/2000 Hoshino ..... 84/298
6,998,526 B1 * 2/2006 Sims et al. ..... 84/318
7,579,536 B2 * 8/2009 Bonebrake ..... 84/312 R

* cited by examiner

*Primary Examiner*—Kimberly R Lockett

(57) ABSTRACT

The basic premise of this invention is to describe and reduce to practice a phenomena by which a string—which is generally known as a singular straight line having a certain tension, diameter and length that produces a vibration—can, when put in a network consisting of a plurality of strings connected together at one or more junction points and radiating therefrom, create a new entity known as a <<network of strings>> which has new vibrating properties. As the vibration, in the form of a wave, travels through a first segment of the network, it splits at the first junction point met where it will travel onto at least one other string but preferably two or more strings. Transferring the original wave's energy over to the other strings in the network makes them vibrate as well and when the waves in the other strings come back to the junction, another transfer of energy occurs and part of the vibrations, which was altered by the properties of each given string, creates a pattern of vibrations which can be added or subtracted which results in complex wave patterns.

5 Claims, 5 Drawing Sheets

MUSICAL STRING NETWORKS

Figure 1:
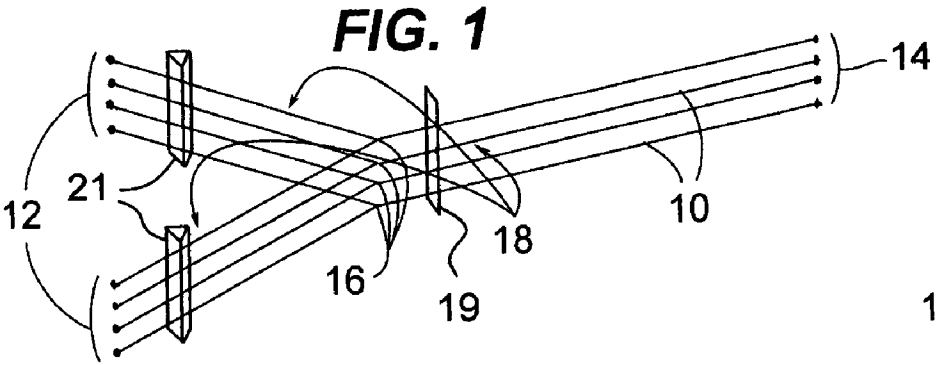

This application claims priority based on provisional application 60/469,590 filed May 12, 2003 for claims 1 and 2

BACKGROUND OF THE INVENTION

1. Field of the Invention

This invention relates generally to musical instruments but more particularly to instruments using one or more networks of interconnected strings that resonate as networks.

2. Background

String instruments have been known since prehistory and Pythagoras was the first known scientist to describe some basic properties such as vibrating strings producing harmonious tones when the ratios of the lengths of the strings are whole numbers, and that these ratios can be extended to other instruments. Over the following centuries, advances in physics and mathematics have made it possible to more closely analyze and understand waves traveling through physical strings. As a result, new and unexpected results can be achieved and new sounds can be produced by musical instruments not imagined before.

SUMMARY OF THE INVENTION

The basic premise of this invention is to describe and reduce to practice a phenomena by which a string—which is generally known as a singular straight line having a certain tension, diameter and length that produces a vibration—can, when put in a network consisting of a plurality of strings connected together at one or more junction points and radiating therefrom, create a new entity known as a <<network of strings >> which has new vibrating properties. As the vibration, in the form of a wave, travels through a first segment of the network, it splits at the first junction point met where it will travel onto at least one other string but preferably two or more strings. Transferring the original wave's energy over to the other strings in the network makes them vibrate as well and when the waves in the other strings come back to the junction, another transfer of energy occurs and part of the vibrations, which was altered by the properties of each given string, creates a pattern of vibrations which can be added or subtracted which results in complex wave patterns.

Experimentally, string networks have been created on three necked guitar like instruments with a plurality of sets of three strings radiating from the junction point for each of the plurality of sets of three strings. In order to build a guitar like instrument and understand how it will work and predict the type of frequencies it will produce, it is important to apply a mathematical formula described herein.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIG. 1 Perspective view of a triad network for a guitar like instrument.

Figure 2:
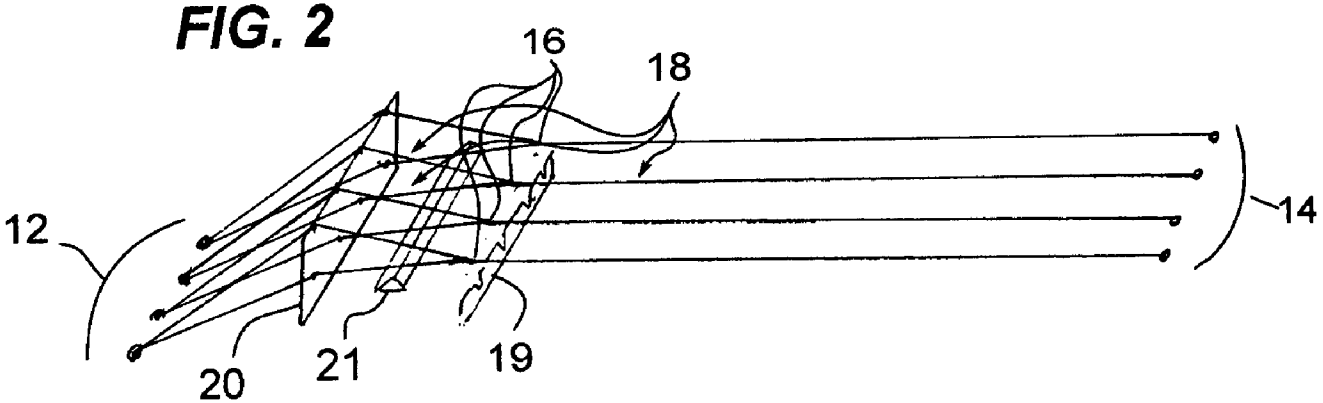

FIG. 2 Perspective view of a triad network for a violin like instrument.

Figure 3:
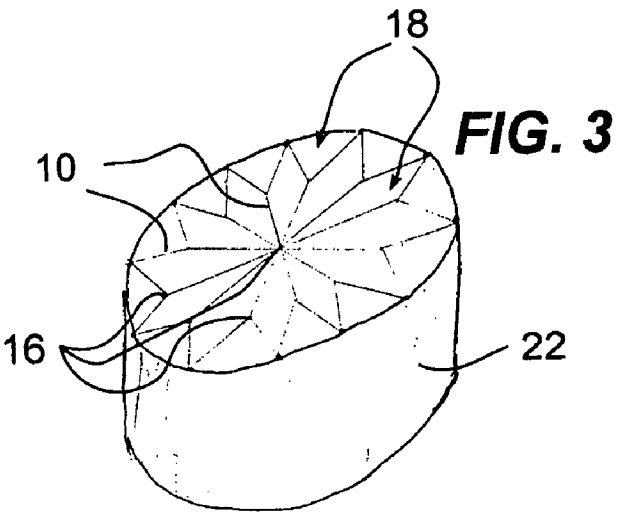

FIG. 3 Perspective view of a multiple network for a percussion instrument.

Figure 4:
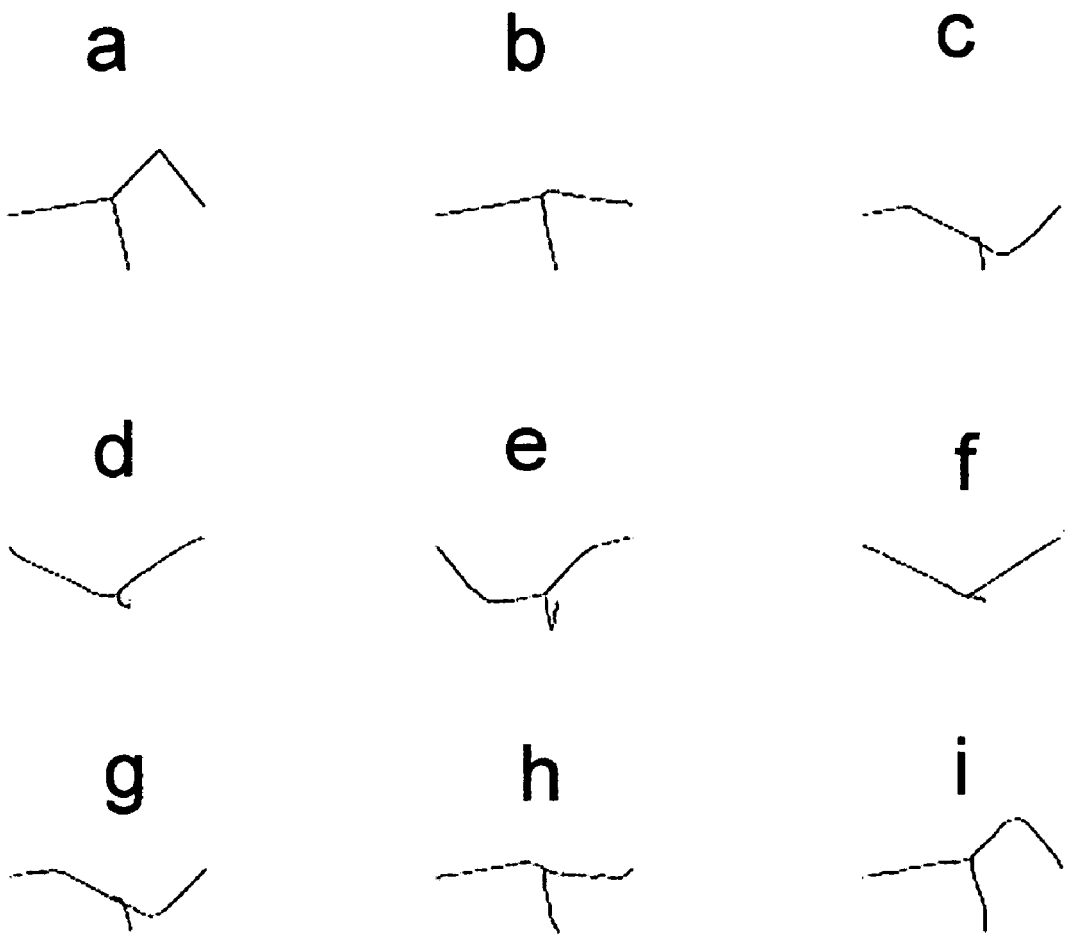

FIG. 4 Diagrams of a computer simulation of wave pattern.

Figure 5:
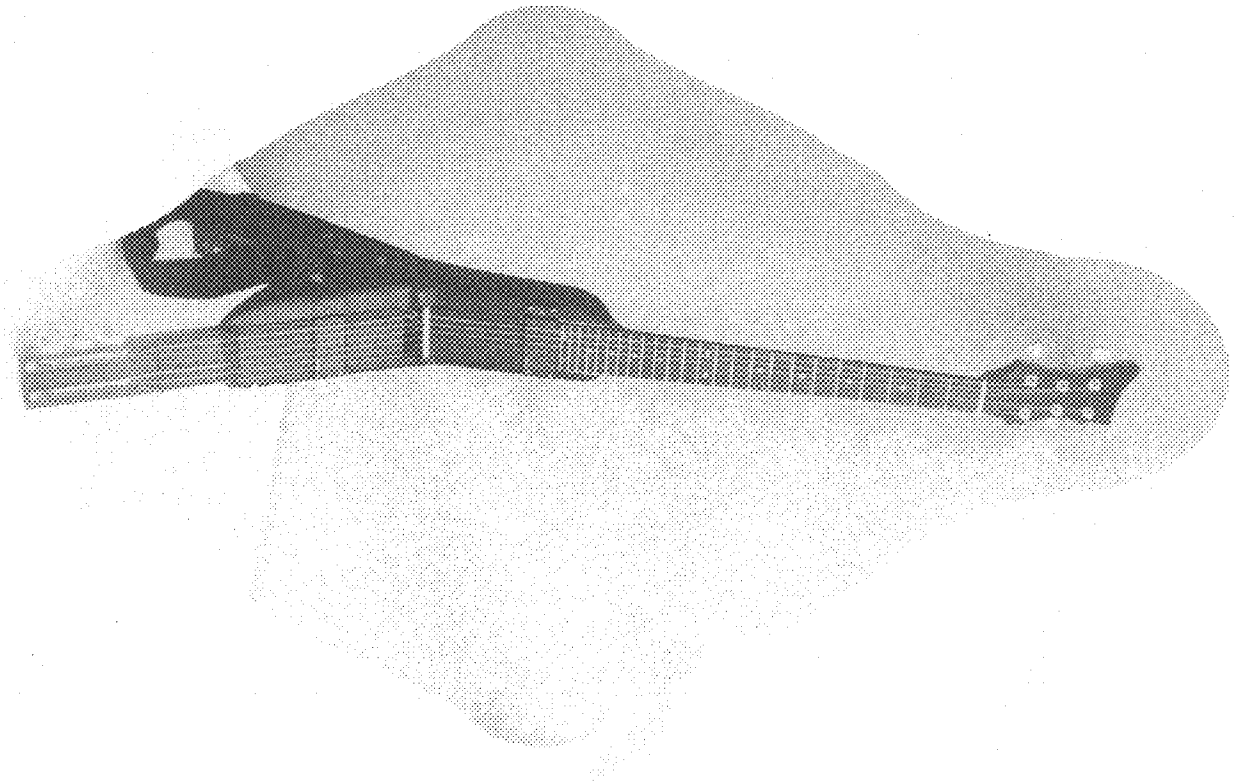

FIG. 5 Perspective view of a guitar like instrument.

Figure 6:
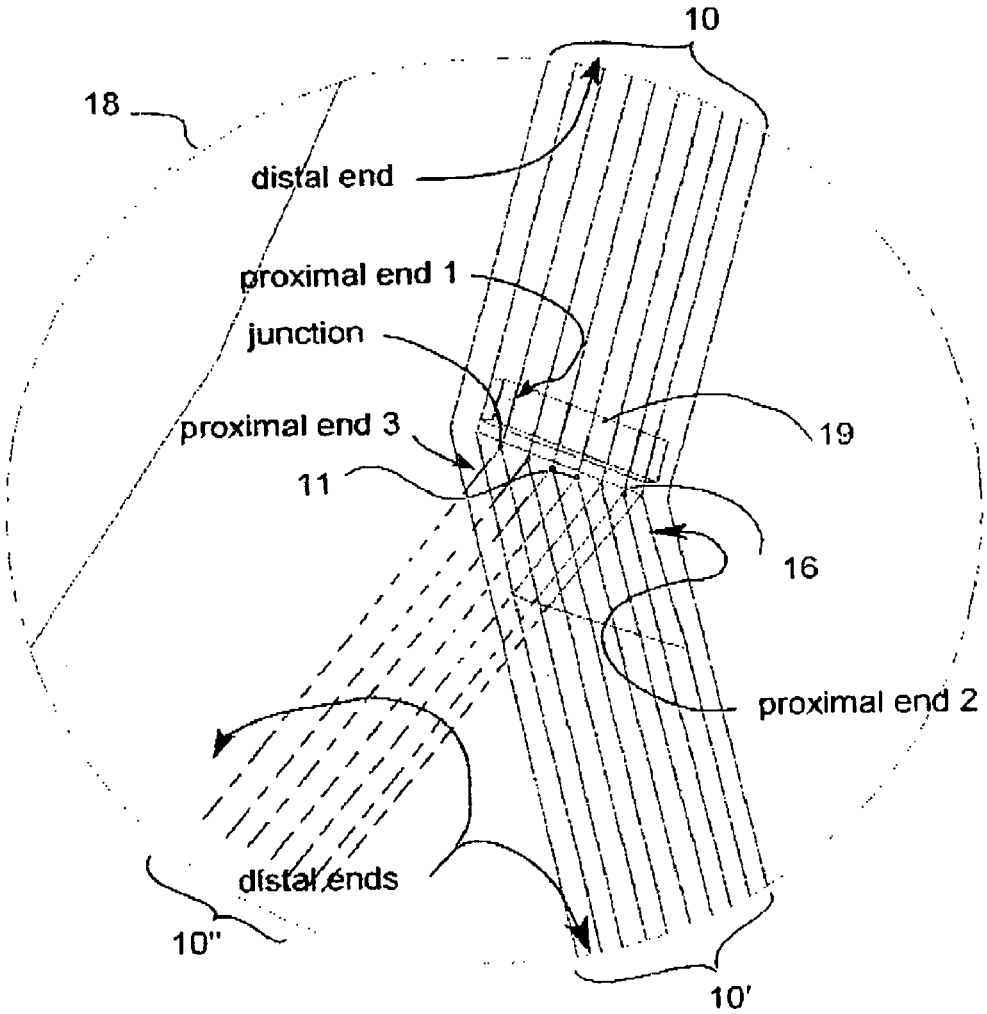

FIG. 6 Close up view of the connection means at the junction point.

Figure 7:
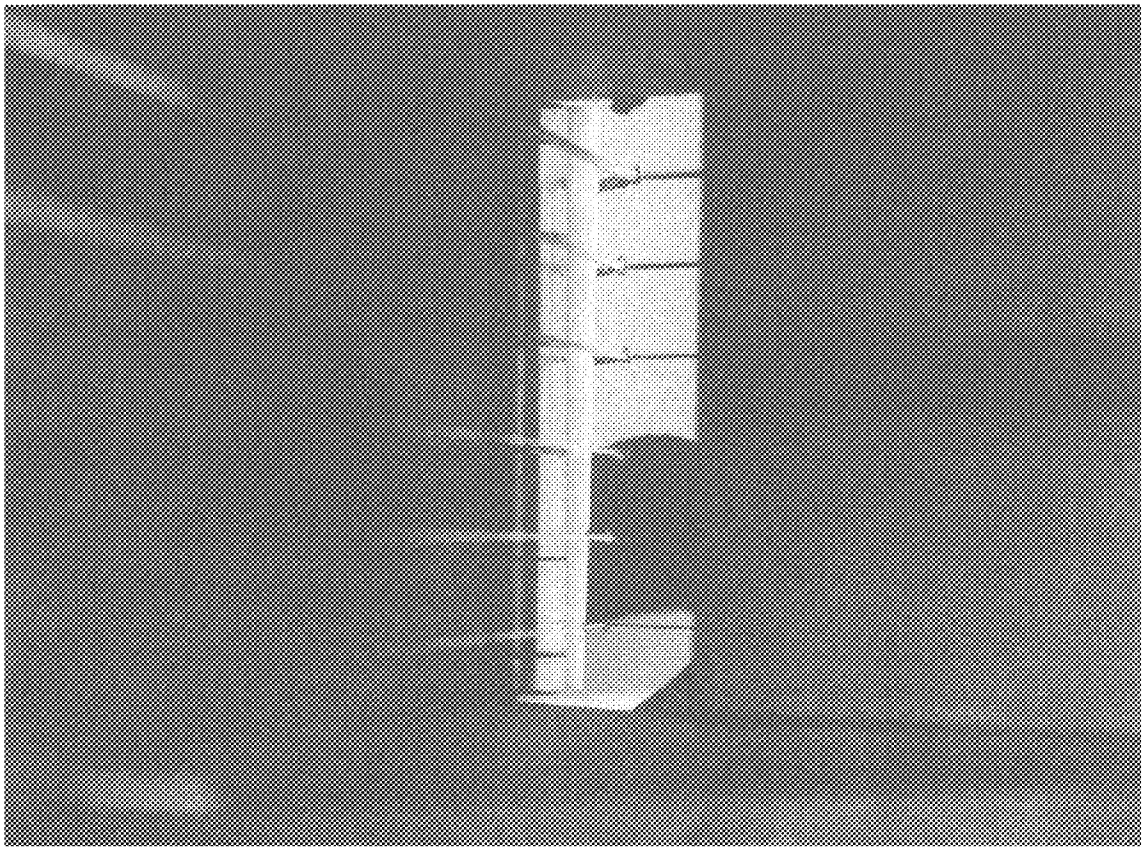

FIG. 7 Alternate close up view of the connection means at the junction point.

DETAILED DESCRIPTION OF THE PREFERRED EMBODIMENT

As shown in FIGS. 1-2, in a network of strings (18) some strings (10) are fixedly attached to fixed points (12) while others are fixedly attached to a tunable point (14). As shown in FIG. 5, all points can be tunable while some can be fixed. Each set of strings (10) in a network of strings (18) meets at a junction point (16) which is from where new tonalities can be created. To increase versatility, by using a movable stopper (19) an instrument can be converted to a regular instrument (example a guitar) by moving the stopper (19) in a position in which it makes physical contact with the strings so as to separate the strings (10) on one side of the stopper (19) from the strings (10) on the other side of the stopper (19). In this configuration, the network of strings (18) is no longer active and the instrument can be played like a regular instrument of its type. By disengaging the movable stopper (19) from the strings (10) so that there is no physical contact between the stopper (19) and the strings (10), reestablishes the network of strings (18). Movable bridges (21) act like those found on regular instruments such as guitars or violins but are movable so that they can be selectively positioned at various points along the strings (10) so as to vary the ratio between the frequencies that make up the spectre of frequencies produced by the instrument. The stopper (19) is very similar to the bridge (21) in the sense that both have the same purpose of stopping the vibrations in the strings, so it could be conceivable that the stopper (19) could be selectively positioned at various points along the strings (10).

The principle of network of strings (18) can also be applied to other stringed instruments, such as the violin like instrument of FIG. 2 where a bridge (20) has two levels.

In FIG. 3, a percussion instrument having a frame (22) can also be built using a complex network of strings (18) having one or more junction points (16).

Complex frequency patterns can be generated as shown in the series of computer generated diagrams of FIG. 4 shown here as examples of the many possibilities. In these examples, amplitude has been exagerated to better visualize the movement.

FIG. 5-7 show one method of creating network of strings (18) by having one string (10) terminating in a loop (11), and through this loop (11) passes another string (10'). Another method of creating a network of strings (18) is to create it during manufacturing process which is feasible for thicker strings wherein a string is wound around a thinner string as is well known in the art but in the case of thinner strings, such a process does not yet exist and could be part of another patent application.

Although real prototypes were built using angles of 60 or 120 or 150 degrees between strings (10) in the network of strings (18), there are a multitude of angles possible, each having its own characteristic wave pattern. In order to determine the sound possibilities of an instrument, the wave pattern of the network of strings (18) can be predicted using mathematical formulas and can be obtained using different methods. As mathematical science evolves, different mathematical means could be employed that are either simpler to apply or which can give better results over a wider variety of parameters. The following mathematical formula is given as one example of possible means to predict the behavior of the network of strings (18) under various parameters:

In the case of a network having one junction point for N sections of string whose lengths, mass densities and tensions are respectively designated li, di and Ti, i=1, 2, . . . , N, the eigenvalues allowing one to establish the corresponding vibration frequency spectrum of the network are the solutions of $$\sum_{i=1}^{N}\left[\frac{n_i}{n_1}\cos\left(\frac{l_i r}{c_i}\right)\prod_{\substack{j=1\\ j\neq i}}^{N}\sin\left(\frac{l_i r}{c_j}\right)\right]=0$$

where $c_i=\sqrt{T_i/d_i}$ and $n_i=c_i d_i$. If $r_k$, k=1, 2, . . . , are the roots of this equation, then the corresponding eigenfunctions are $$P_k(x)=\left[\cos\frac{l_1 r_k x}{\pi c_1}+\left(\frac{n_2}{n_1}\cot\frac{l_2 r_k}{c_2}+\ldots+\frac{n_N}{n_1}\cot\frac{l_N r_k}{c_N}\right)\sin\frac{l_1 r_k x}{\pi c_1},\ \cos\frac{l_2 r_k x}{\pi c_2}-\left(\cot\frac{l_2 r_k}{c_2}\right)\sin\frac{l_2 r_k x}{\pi c_2},\ \ldots,\ \cos\frac{l_N r_k x}{\pi c_N}-\left(\cot\frac{l_N r_N}{c_N}\right)\sin\left(\frac{l_N r_k x}{\pi c_N}\right)\right]^T$$

If $u^i(x_i, t)$, i=1, 2, . . . , N, $0\leqq x_i\leqq l_i$, $t\geqq 0$ designate the position of the point $x_i$ at time t, and $$u^i(x_i, 0)=F^i(x_i),\ u_t^i(x_i, 0)=G^i(x_i),$$

are the initial displacement and velocity, respectively, then the vibrations of the network are described by $$u^i(x_i, t)=v^i(\pi x_i/l_i, t),$$

where $$\left[v^1(x,t), v^2(x,t), \ldots, v^N(x,t)\right]^T=\sum_{k=1}^{\infty}(a_k\cos r_k t+\hat{a}\sin r_k t)P_k(x)$$

$$a_k=\frac{\langle\langle F, P_k\rangle\rangle_L}{\langle\langle P_k, P_k\rangle\rangle_L},\qquad \hat{a}_k=\frac{\langle\langle G, P_k\rangle\rangle_L}{r_k\langle\langle P_k, P_k\rangle\rangle_L},$$

$$F(x)=\left[F^1(l_1 x/\pi), F^2(l_2 x/\pi), \ldots, F^N(l_N x/\pi)\right]^T,$$

$$G(x)=\left[G^1(l_1 x/\pi), G^2(l_2 x/\pi), \ldots, G^N(l_N x/\pi)\right]^T,$$

with the scalar product $\langle\langle\ \rangle\rangle$ defined by $$\langle\langle f(x), g(x)\rangle\rangle=\int_0^{\pi}\left(\sum_{i=1}^{N}l_i d_i f_i(x)\,g_i(x)\right)dx,$$

where $f(x)=(f_1(x), f_2(x), \ldots, f_N(x))^T$ and $g(x)=(g_1(x), g_2(x), \ldots, g_N(x))^T$.

The invention claimed is:

1. A structure to be incorporated into a musical instrument comprising:

a plurality of strings, each having one proximal end and one distal end;

and each said one proximal end connected to at least two other said proximal ends at a junction point and radiating therefrom;

and each said strings having their said distal ends attached to a structural element in order to create a tension on said strings so as to create a network of strings;

a movable stopper movable between a position where it makes physical contact with strings so as to acoustically separate the strings on one side of said stopper from strings on the other side of said stopper wherein in this configuration, said network of strings is no longer active and by disengaging said movable stopper from said strings so that there is no physical contact between said stopper and said strings so as to re-establish said network of strings.

2. A structure to be incorporated into a musical instrument as in claim 1 having the following mode of operation:

as the vibration, in the form of a wave, travels through a first segment of said network of strings, it splits at said junction point from where it travels onto two or more strings;

transferring said wave's energy over to said two or more strings in said network of strings making said string vibrate as well and when waves in said at least one other string come back to said junction point, another transfer of energy occurs and part of the vibrations, which was altered by the properties of each given said string, creates a pattern of vibrations.

3. A structure to be incorporated into a musical instrument as in claim 1 having a mode of operation described by the following equation:

in the case of a network having one junction point for N sections of string whose lengths, mass densities and tensions are respectively designated $l_i$, $d_i$ and $T_i$, i=1, 2, . . . , N, the eigenvalues allowing one to establish the corresponding vibration frequency spectrum of the network are the solutions of $$\sum_{i=1}^{N}\left[\frac{n_i}{n_1}\cos\left(\frac{l_i r}{c_i}\right)\prod_{\substack{j=1\\ j\neq i}}^{N}\sin\left(\frac{l_i r}{c_j}\right)\right]=0$$

where $c_i=\sqrt{T_i/d_i}$ and $n_i=c_i d_i$. If $r_k$, k=1, 2, . . . , are the roots of this equation, then the corresponding eigen functions are $$P_k(x)=\left[\cos\frac{l_1 r_k x}{\pi c_1}+\left(\frac{n_2}{n_1}\cot\frac{l_2 r_k}{c_2}+\ldots+\frac{n_N}{n_1}\cot\frac{l_N r_k}{c_N}\right)\sin\frac{l_1 r_k x}{\pi c_1},\ \cos\frac{l_2 r_k x}{\pi c_2}-\left(\cot\frac{l_2 r_k}{c_2}\right)\sin\frac{l_2 r_k x}{\pi c_2},\ \ldots,\ \cos\frac{l_N r_k x}{\pi c_N}-\left(\cot\frac{l_N r_N}{c_N}\right)\sin\left(\frac{l_N r_k x}{\pi c_N}\right)\right]^T$$

If $u^i(x_i, t)$, i=1, 2, . . . , N, $0x_i l_i$, $t\geqq 0$ designate the position of the point $x_i$ at time t, and $$u^i(x_i, 0)=F^i(x_i),\ u_t^i(x_i, 0)=G^i(x_i),$$

are the initial displacement and velocity, respectively, then the vibrations of the network are described by $$u^i(x_i, t)=v^i(\pi x_i/l_i, t),$$

where $$\left[v^1(x,t), v^2(x,t), \ldots, v^N(x,t)\right]^T = \sum_{k=1}^{\infty}(a_k \cos r_k t + \hat{a} \sin r_k t)P_k(x)$$

$$a_k = \frac{\langle\langle F, P_k\rangle\rangle_L}{\langle\langle P_k, P_k\rangle\rangle_L}, \qquad \hat{a}_k = \frac{\langle\langle G, P_k\rangle\rangle_L}{r_k\langle\langle P_k, P_k\rangle\rangle_L},$$

$$F(x) = \left[F^1(l_1 x/\pi), F^2(l_2 x/\pi), \ldots, F^N(l_N x/\pi)\right]^T,$$

$$G(x) = \left[G^1(l_1 x/\pi), G^2(l_2 x/\pi), \ldots, G^N(l_N x/\pi)\right]^T,$$

with the scalar product $\langle\langle\ \rangle\rangle$ defined by $$\langle\langle f(x), g(x)\rangle\rangle = \int_0^{\pi}\left(\sum_{i=1}^{N} l_i d_i f_i(x) g_i(x)\right)dx,$$

-continued where $f(x) = (f_1(x), f_2(x), \ldots, f_N(x))^T$ and $g(x) = (g_1(x), g_2(x), \ldots, g_N(x))^T$.

4. A structure to be incorporated into a musical instrument as in claim 1 wherein:

a movable bridge can be selectively positioned at various points along said strings so as to vary the ratio of frequencies.

5. A structure to be incorporated into a musical instrument as in claim 1 wherein:

said stopper can be selectively positioned at various points along said strings.

* * * * *